US006659140B2

(12) United States Patent
Yamakawa

(10) Patent No.: US 6,659,140 B2
(45) Date of Patent: Dec. 9, 2003

(54) APPARATUS AND METHOD FOR CUTTING BRAID OF SHIELDED WIRE

(75) Inventor: Nobuaki Yamakawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/083,603

(22) Filed: Feb. 27, 2002

(65) Prior Publication Data

US 2002/0121159 A1 Sep. 5, 2002

(30) Foreign Application Priority Data

Mar. 2, 2001 (JP) ..... 2001-058476

(51) Int. Cl.[7] ..... B21F 11/00
(52) U.S. Cl. ..... 140/71 R; 29/828
(58) Field of Search ..... 140/107, 71 R; 30/90.1; 29/461, 828; 72/327

(56) References Cited

U.S. PATENT DOCUMENTS 4,719,697 A * 1/1988 Schwartzman et al. ..... 29/828
4,763,410 A * 8/1988 Schwartzman ..... 29/828

* cited by examiner

*Primary Examiner*—Lowell A. Larson
(74) *Attorney, Agent, or Firm*—Armstrong, Kratz, Quintos, Hanson & Brooks, LLP

(57) ABSTRACT

A braid cutting device 7 of a shielded wire includes a die 107 located outside an exposed braid 22 of a shielded wire 15, a braid opening means (110), a circular punch which advance inside the braid, a guide member 109 for guiding the braid 22 in a direction of opening the braid 22 and guiding the inner sheath of the shielded wire inside the braid inside the punch 108. The guide member 109 can be divided into two segments. When the punch 108 is moved forward, the guide member can open outwardly and move backward by a driving means 123 and moving means 122. The braid 22 is opened by the opening means and further opened along the outer slope of the guide member 109. The braid 22 is further opened by the guide member in such a way that the guide member is opened. The inner sheath of the braid is guided along the inner slope of the guide member into the inside of the circular punch 108. The braid is cut into a prescribed length between the punch approached into the inside of the braid and the die 107 located outside the braid. In this configuration, the braid of a shielded wire can be cut automatically and effectively.

5 Claims, 4 Drawing Sheets

15

15
19a
19
19b 15
19
21
20

15
19
20
22

15
19
22
24
19b 15
19
22
24

15
19
23
19b
24

15
19
23
24

15
19
23
24
25

15
19
23
24
26
27

APPARATUS AND METHOD FOR CUTTING BRAID OF SHIELDED WIRE

BACKGROUND OF THE INVENTION

1. Field of the Invention

This invention relates to an apparatus and method for effectively automatically cutting a braid of a shielded wire having a relatively large diameter for use in an electric vehicle and others.

2. Description of the Related Art

Traditionally, a shielded wire was processed manually in all the steps.

Specifically, the sheath of the tip of a shielded wire cut into segments of a prescribed length is stripped using a tabletop tool so that the braid of conductive metal is exposed. The braid is cut into segments each having a prescribed length. With a shield contact of conductive metal manually inserted into the shielded wire, the braid is folded back toward the contact using a center punching. With a shield pipe of conductive metal manually inserted in the shielded wire and braid sandwiched between and kept in contact with the shield contact and the shield pipe, the shield pipe is squeezed using a squeezing machine. Further, the inner face at the tip of the shielded wire is stripped using the tabletop tool so that a terminal is connected to a core wire by a crimping machine (The shape and other details of the shield contact and shield pipe can be seen from FIG. 3).

The shielded wire is used in such a mode that a connecting flange is combined with the shield pipe and earth-connected to a vehicle body along the outer surface of the housing of resin. The terminal of the shielded wire is connected to a motor, inverter or battery of an electric vehicle.

However, in the above conventional means for cutting the braid of the shielded wire, the braid was manually cut using snips. Therefore, the length of each of the segments of the cut braid is uneven. The tip of cut braid is liable to be irregular. The quality is not stable, and a large number of man-hours is required. This presents a problem of increasing the production cost.

SUMMARY OF THE INVENTION

In view of the above problem, a first object of this invention is to provide an apparatus which can cut the braid of a shielded wire into precise lengths cleanly with no irregularity and effectively with a small number of man-hours.

A second object of this invention is to provide a method for cutting the braid of a shielded wire into precise lengths cleanly with no irregularity and effectively with a small number of man-hours.

In order to attain the above first object, in accordance with this invention, there is provided a braid cutting apparatus for a shielded wire comprising: a die located outside an exposed braid of the shielded wire; means for opening the braid; a punch which is to advance inside the braid; and a guide member for guiding the braid in a direction to open further and an inner sheath of the shielded wire inside the braid to an inside of the punch.

In this configuration, the exposed braid of the shielded wire is inserted into the inside of die, the braid is opened outwardly in taper by a braid opening means, the inner sheath of the shielded wire is inserted in the inside of the punch and the braid is further opened in taper outwardly by a guide member. For this reason, the tip of the punch is inserted surely and smoothly inside the braid, i.e. between the braid and the inner sheath of the shielded wire so that the braid can be surely sheared between the punch and the die.

In the above apparatus, preferably, the opening means comprises: a pair of opening pallets which are freely reclosable, a pair of sliding members with the pair of opening pallets fixed; a link for moving the pair of sliding members in opposite directions; and driving means for swinging the link.

In this configuration, the link is swung by the driving means so that the pair of sliders are opened or closed simultaneously with the opening pallets. Therefore, the braid of the shielded wire is pressed repeatedly by the opening pallets under appropriate force. Accordingly, the braid can be surely opened in a trumpet without being injured.

In the apparatus described above, preferably, the guide member is made dividable, and when the punch advances, the guide member is opened outwardly by the driving means and a moving means to retreat.

In this configuration, since the guide member opens and retreats, when it is opens, the braid is opened further outwardly. For this reason, the punch is inserted more surely inside the braid.

In order to attain the second object, there is provided a method of cutting a braid of a shielded wire comprising the steps of: opening an exposed braid of the shielded wire, further opening the braid along an outer slope of a guide member while guiding an inner sheath of the shielded wire inside the braid to an inside of a circular punch, and shearing the braid into a required length between the punch and a die located outside the braid while advancing the punch inside the braid.

In this configuration, the braid opened primarily opened by the opening means is guided along the outer slope of the guide member so that it is further (secondarily) opened greatly outwardly. The inner sheath of the shielded wire is smoothly inserted into the guide member, i.e. inside the punch along the inner slope of the guide member.

In the method described above, preferably, after the braid is opened along an outer slope of the guide member, the guide member is opened outwardly.

In this configuration, since the braid is opened further outwardly when the guide member is opened, the punch is inserted more surely inside the braid. Thus, the tip of the punch and that of the braid do not interfere with each other so that the braid does not bend inwardly. This prevents poor cutting of the braid.

The above and other objects and features of this invention will be more apparent from the following description taken in conjunction with the accompanying drawings.

DESCRIPTION OF THE PREFERRED EMBODIMENTS

Figure 1:
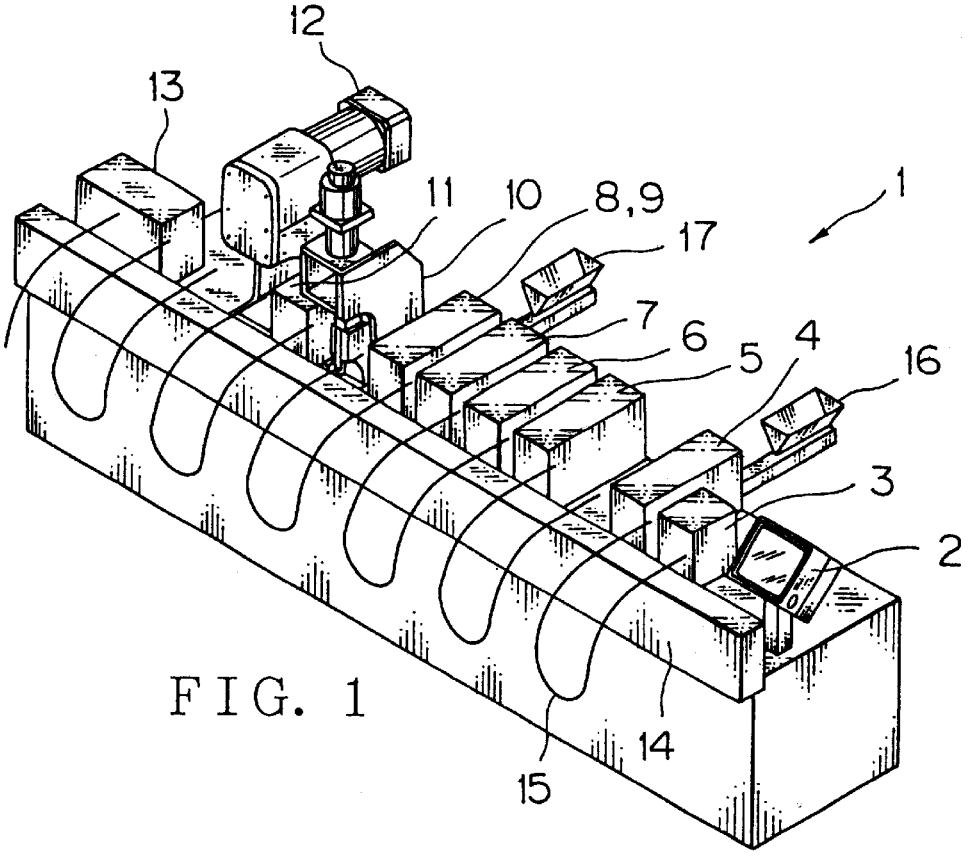
FIG. 1 is a schematic perspective view of an embodiment of a shielded wire machining device inclusive of a braid cutting device of a shielded wire according to this invention.

Now referring to the drawings, an explanation will be given of an embodiment of this invention.

FIG. 1 schematically shows an embodiment of a shielded wire processing device including a device for cutting the braid of a shielded wire according to this invention.

A shielded wire processing apparatus, generally 1 includes individual devices arranged successively from the right side, i.e., an operation console 2 for performing a change in a product number, switching between a manual operation and an automatic operation, etc., a wire setting device 3, a shield contact fitting device 4, a sheath incision device 5, a sheath extracting device 6, a braid cutting device 7, a braid fold-back device 8, shield pipe inserting device 9 (8 and 9 are illustrated as a single device for brevity of illustration), sheath pipe squeezing device 10, a peeling device 11, a terminal squeezing device 12, a product drawing device 13, and a conveying device 14 for moving a shielded wire 15 along the respective devices 3 to 13. These devices 3 to 13 are arranged in parallel at substantially regular intervals.

In FIG. 1, reference numeral 16 denotes a hopper for supplying a shield contact, and reference numeral 17 denotes a hopper for supplying a shield pipe. The shielded wires 15 each may a thick wire having a sectional area of about 15 $mm^2$. The shielded wires 15 folded back in a U-shape or not folded back are set one by one in parallel in the wire setting device 3 at the right end of the conveying device 14.

Now referring to FIGS. 1 and 2, an explanation will be given of a shielded wire processing method using the shielded wire processing device 1, and its operation.

Figures 2A, 2B, 2C, 2D, 2E, 2F, 2G, 2H, 2I, 2J:
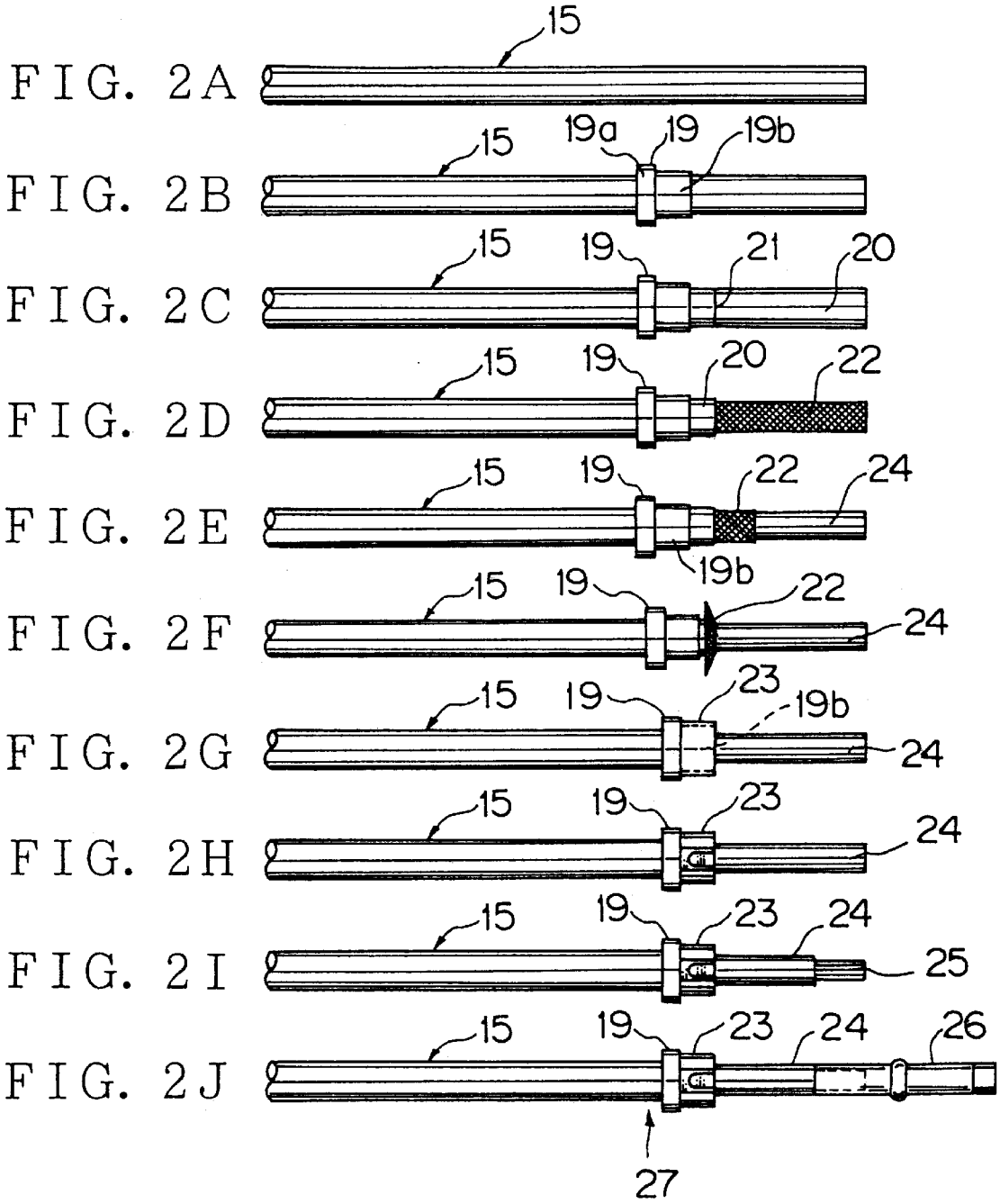
FIGS. 2A to 2J are plan views showing the machining method of the shielded wire.

First, as seen from FIG. 2A, the shielded wire 15 cut into a segment having a prescribed length is set in the shield setting device 3 by an operator. The only operation performed by the operator is to set the wire. When the shielded wire 15 is set, the wire conveying device 14 is shifted by one pitch leftward to convey the shielded wire 15 to the adjacent shield contact inserting device 4.

Figure 3:
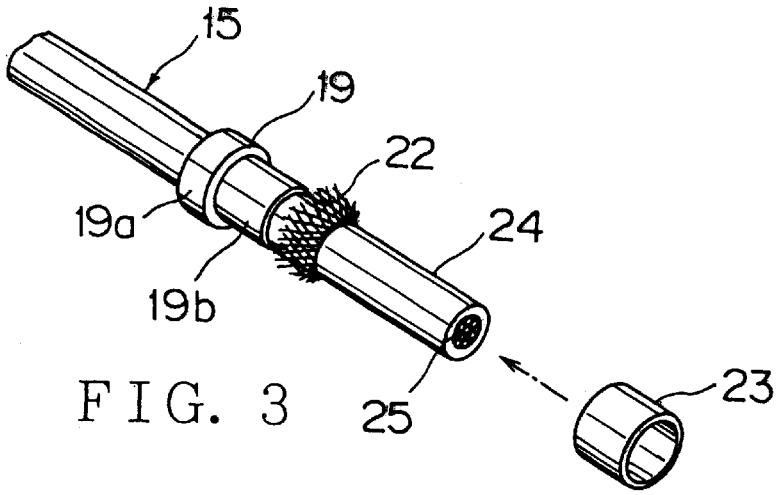
FIG. 3 is an exploded perspective view showing the state on the way of machining the shielded wire.

As seen from FIG. 2B, a ring-shaped shield contact 19 of conductive metal is fit over the shielded wire 15 by the shield contact fitting device 4. As also seen from FIG. 3, the shield contact 19 is composed of a large-diameter segment 19*a* and a small-diameter segment 19*b* which are stepped. The shielded wire 15 inserted into the shield contact 19 is conveyed to the sheath incision device 5 by the conveyer device 14. As seen from FIG. 2C, a circular incision 21 is made on the insulating sheath (outer sheath) 20 of the shielded wire 15 at a prescribed position located nearer to the tip of the wire than the shield contact 19.

The shielded wire 15 is conveyed to the sheath drawing device 6. As seen from FIG. 2D, the sheath 20 is drawn out so that an internal metallic braid 22 is exposed over a prescribed length. It is needless to say that the braid 22 is composed of slender metallic wires which are knitted in a crossing manner as seen from FIG. 3. The shielded wire is conveyed to the braid cutting device 7. As seen from FIG. 2E, the exposed braid 22 is cut into a prescribed length so that an insulating inner sheath 24 is exposed.

The shielded wire 15 is conveyed to the braid fold-back device 8. As seen from FIG. 2F, the braid 22 is folded back toward the small-diameter portion 19*b* of the shield contact 19. Further, a ring-shaped shield pipe 23 of conductive metal is inserted the from the tip side of the shielded wire 15 so that the braid 22 (not shown) is sandwiched between and brought in contact with the outer surface of the small diameter portion 19*b* of the shield contact 19 and the inner surface of the shield pipe 23. The angle of fold-back of the braid 22 ranges from 90° to 180°.

The shielded wire 15 is conveyed to the shield pipe squeezing device 10. As seen from FIG. 2H, the shield pipe 23 is squeezed in a hexagon so that it is fixed to the shield contact 19. Since the braid 23 is sandwiched between the shield contact 19 and the shield pipe 23, the shield contact 19 and the shield pipe 23 are firmly fixed to the shielded wire 15.

The shielded wire 15 is conveyed to the peeling device 11. As seen from FIG. 2I, the tip side of the inner sheath 24 is peeled over a prescribed length so that a core (conductor) is exposed. Further, the shielded wire 15 is conveyed to the terminal squeezing device 12. As seen from FIG. 2J, a terminal 26 is crimped on the exposed core 25. Finally, the product 27 of the shielded wire is taken from the shielded wire processing device 1 into an external pallet (not shown) with the aid of the product drawing device 13.

Incidentally, the terminal squeezing device 12 may be provided separately from the shielded wire processing device 1.

Now referring to FIGS. 4 to 8, an explanation will be given of an embodiment of a device for cutting the braid of a shielded wire and the braid cutting method according to this invention.

Figure 4:
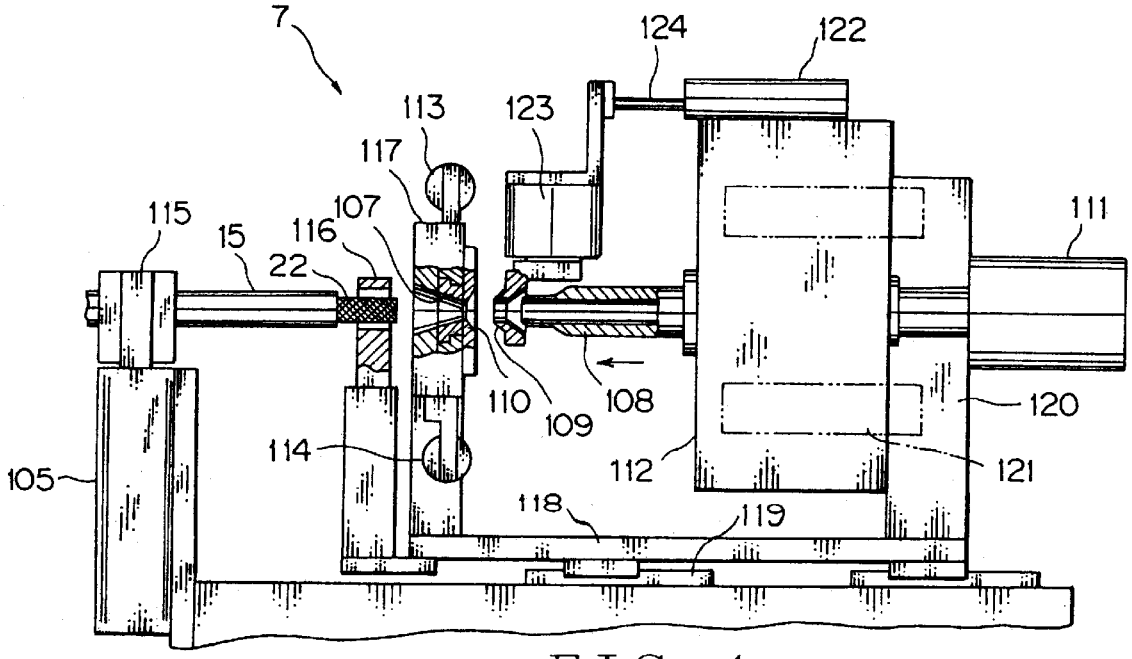
FIG. 4 is a side view of an embodiment of the braid cutting device for a shielded wire according to this invention.

In FIG. 4, reference numeral 107 denotes a ring-shaped die for cutting a braid; 109 a ring-shaped guide member; 110 a ring-shaped braid opening pallet; 111 an air-actuated or hydraulic horizontal cylinder for primarily advancing a punch 108; and 112 a large-sized and strong air-actuated or hydraulic cylinder for secondarily advancing the punch 108 and cutting the braid 22 of the shielded wire 15 between the die 107 and the punch 108. Reference numerals 113 and 114 (FIG. 5) denote air cylinders (driving means) for laterally opening/closing the ring-shaped braid opening pallet 110, respectively.

The shielded wire 15 is caught by a chuck 115 in its intermediate portion in the longitudinal direction. The shielded wire 15 is also supported by a supporting chuck (supporting member) 116 in its tip side so that it is movable in the longitudinal direction. The chuck 115 includes a pair of left and right catching pallets. The chuck 115 is opened/closed by the air chuck cylinder 105. The wire chuck in the conveyer device 14 (FIG. 1) has the same structure.

The supporting chuck 116 includes a pair of left and right symmetrical closable pallets which do not catch the shielded wire 15, but horizontally supports it in light contact therewith. The die 107 is located ahead of the supporting chuck 116. A frame 117 to which the die 107 is fixed and the supporting chuck 116 are integrally fixed to a horizontal base plate 118. The base plate 118 is adapted to be slidable in the longitudinal direction of the wire along a guide rail 119.

The base plate 118 is driven back and forth by a ball screw shaft (not shown). A primary cylinder 111 with a small diameter for moving a punch is attached to the frame 120 extended upright at the rear of the base plate 118. A secondary cylinder 112 with a large diameter is adapted to be movable back and forth relative to a frame 120 by a guiding means 121 such as a guide rail. A horizontal air cylinder (moving means) 122 with a small diameter for moving the guide member back and forth is attached to the secondary cylinder 112. The guide member 109 in a chuck-system is coupled with an opening/closing cylinder 123 which is in turn coupled with a rod 124 of the moving cylinder 122.

Figure 5:
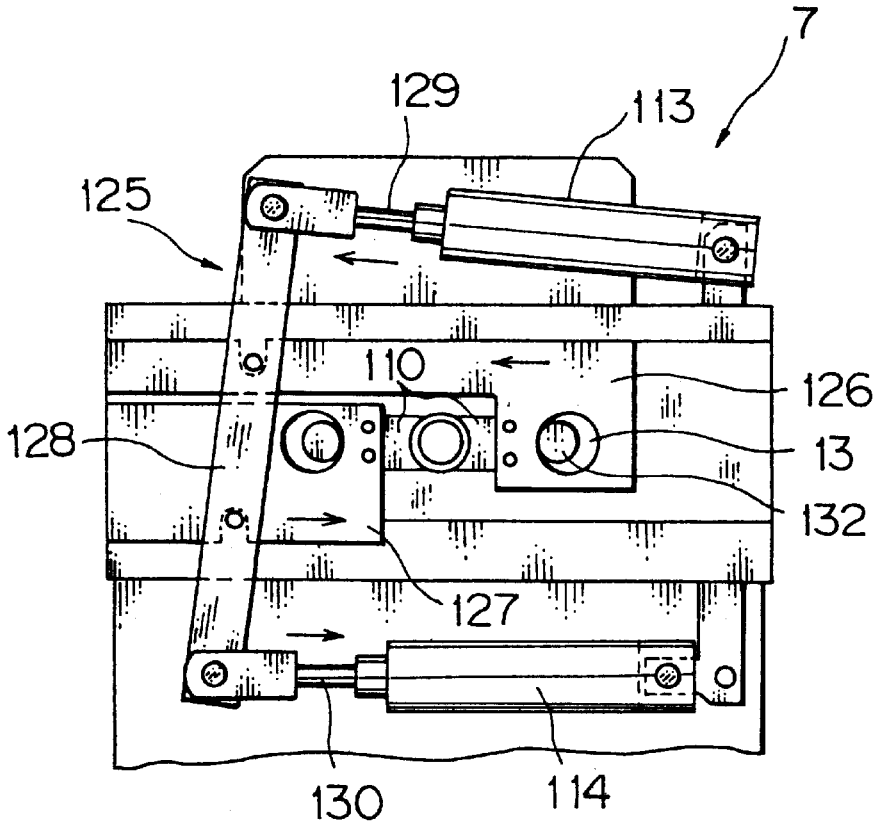
FIG. 5 is a front view showing the braid turn-over means of the braid cutting device.

As seen from FIG. 5, a braid opening means 125 has a pair of left and right braid opening pallets 110 which are attached to sliding plates (sliding member) 126 and 127 which are movable in opposite directions. Each of the sliding plates 126, 127 are engaged with a single substantially vertical link 128 at upper and lower shaft positions. The upper end and lower end of the link 128 are coupled with the rods 129 and 130 of the cylinders 113 and 114, respectively. The stem of each of the cylinders 113 and 114 is rotatably supported. Each of the sliding plates 126 and 127 is adapted to be movable in a horizontal direction (radial direction of the wire) within a gap between a hole portion and a shaft portion.

Figure 6:
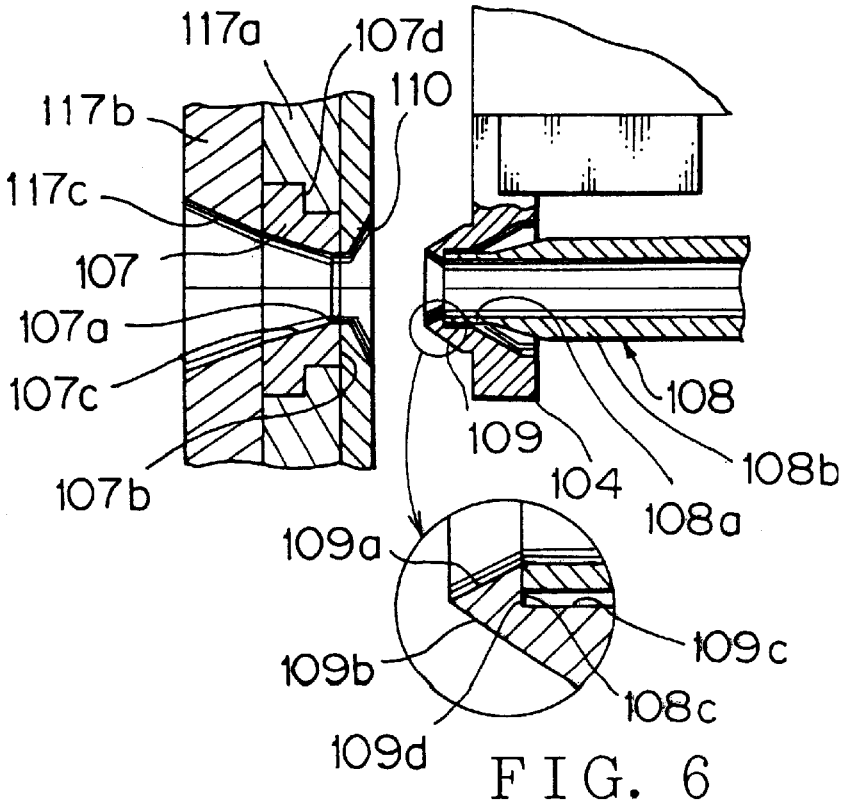
FIG. 6 is a sectional view of the main part of the braid cutting means in FIG. 8.

FIG. 6 is an enlarged view of the cutting means such as the die 107 and punch 108 in FIG. 4. The die 107 is formed in a circular shape. The punch 108 is movable into an inner diameter portion 107*a* of the die 107. The inner diameter portion 107*a* is constituted by a horizontal narrow segment with a uniform inner diameter. This portion is successive to a front vertical plane 107*b* and a rear tapered plane 107*c*. The edge at the front end of the inner diameter portion 107*a* serves as a shearing blade. The outer periphery of the die is stepped and the stepped portion is engaged with an outer front half frame 117*a* so that it is not movable forward.

The braid opening pallets 110 are kept in intimate contact with the front end of the die 107 so as to be slidable in the radial direction. A rear half frame 117*b* is kept in contact with the rear end of the die 107. The tapered plane 107*c* is smoothly successive to the tapered plane 117*c*. Each of the tapered planes 117*c* and 107*c* serves as a guide plane for guiding the tip of the braid 22 of the shielded wire (FIG. 4).

The punch 108 is cylindrically shaped, and composed of a thin segment 108*a* with a small diameter on the tip side and a thick segment 108*b* with a large diameter backward successive thereto. The inner diameter of the thin segment 108*a* is equal to that of the thick segment 108*b*. The outer diameter of the thin segment 108*a* is smaller than that of the thick segment 108*b*. The outer edge 108*c* at the tip of the thin segment 108*a* serves as a shearing blade.

The thin segment 108*a* advances into the inner diameter portion 109*c* of the guide member 109 with a slight gap therefrom. The guide member 109 is formed in a circular shape divided into two left and right segments. The guide member 109 has an inner slope 109*a* for wire guiding, which covers the tip of the thin segment 108*a* of the punch 108, and an outer slope 109*b* for braid guiding.

The inner slope 109*a* is formed is a short length whereas the outer slope 109*b* is formed in a relatively long length extended backward. The inner slope 109*a* is successive to a circular vertical plane 109*d* with which the tip of the thin segment 108*a* of the punch 108 is in contact. The minimum inner diameter of the guide member 109 is equal to the inner diameter of the thin segment 108*a* of the punch 108. Both slopes 109*a* and 109*b* cross to form an acute angle. The tip of the guide member 109 is formed in a wedge shape in section. The guide member 109 is provided integrally to or separately from a pair of left and right arms 104 which can be opened/closed freely. Specifically, the one semi-circular guide member 109 and the other semi-circular guide member 109 are attached to the one arm 104 and the other arm 104, respectively.

The pair of left and right guide members 109 are opened/closed by an opening/closing cylinder 123 (FIG. 4). In opening the guide members, the punch 108 advances toward the die 107. The braid opening pallet 110 has a slightly acute circular tip, whose degree is less than a cutter. In the description of the specification, the "front" of the shielded wire 15 is coincident to the "front" of the die 107. In contrast, the "front" of the punch 108 is opposite to the "front" of the guide member 109.

Figure 7:
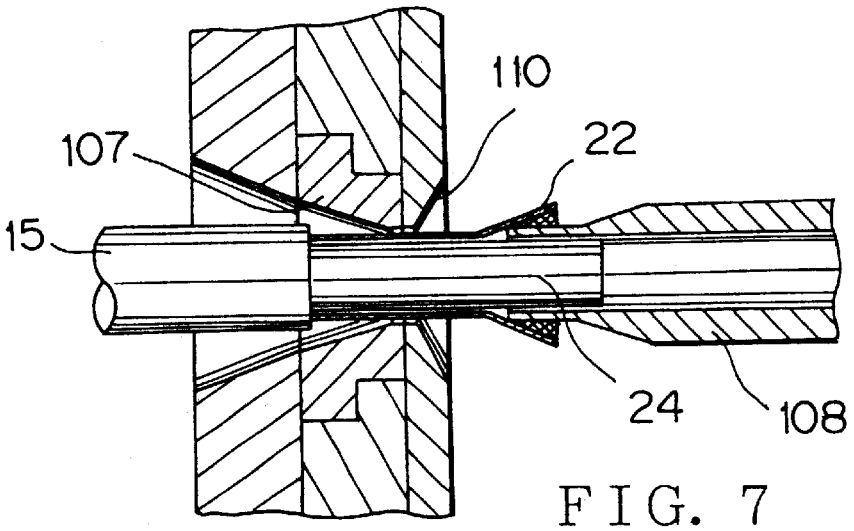
FIG. 7 is a view for explaining the state of cutting the braid.

In FIG. 4, the horizontal base plate 118 is advanced slidably by a ball screwing shaft and servo motor so that the tip of the shielded wire 15 (exposed portion of the braid 22) is inserted into the die 107. In this state, a pair of upper and lower cylinders 113 and 114 are operated several times in opposite directions, respectively. Thus, a link 128 swings so that the braid opening pallets 110 repeatedly open/close integrally to the pair of left and right slide plates 126 and 127. As shown in FIG. 7, the pallets 110 press the braid 22 of the shielded wire 15 against the inner sheath 24 several times (four to five times) so that the braid 22 is gradually expanded in diameter outwardly. Accordingly, the circular punch 108 can be inserted comparatively easily between the braid 22 of the wire 15 and inner sheath 24.

Figure 8:
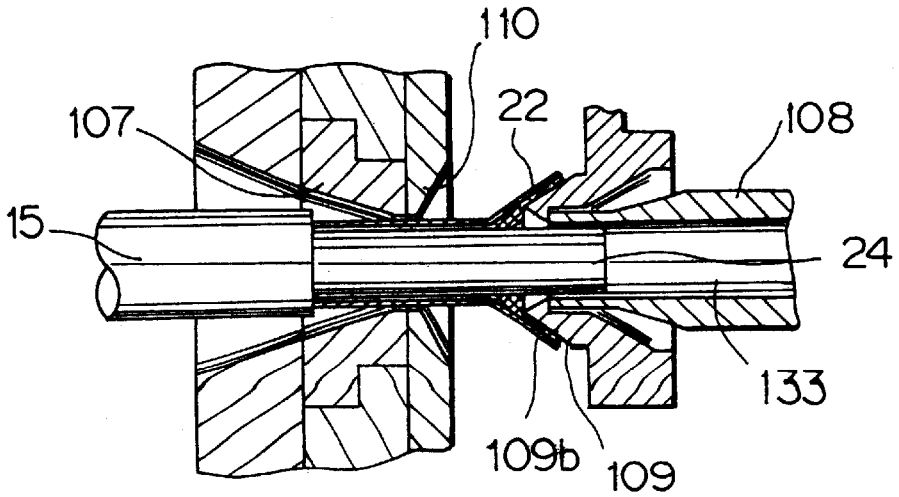
FIG. 8 is a view showing the function of a guide member.

In the state where the braid 22 has been expanded, the secondary cylinder 112, punch 108 and guide member 109 are advanced by the operation of extending the primary cylinder 111 as shown in FIG. 4. Then, as shown in FIG. 8, the inner sheath 24 of the shielded wire 15 is initially (slightly) inserted into the inner diameter portion (inner space) of the punch 108. Simultaneously, the opened portion of the braid 22 slides along the outer slope 109*b* of the guide member 109 so that it is further opened. Since the guide member 109 is opened left and right, the braid 22 is extended more outwardly. In this state, the guide member 109 is moved backward.

The operation of the guide member 109 of opening the braid further facilitates the insertion of the punch 108. When the shielded wire 15 is inserted, the tip of the punch 108 is completely housed in the inner diameter portion 109*c* of the guide member 109 so that interference between the tip of the inner sheath of the shielded wire 15 and that of the tip of the punch 108 is prevented. Thus, the wire can be smoothly inserted.

The guide member 109 is opened outwardly, and moved backward by the compressing operation of the horizontal air cylinder 122 as shown in FIG. 4 so that the secondary cylinder 112 is extended. Then, the punch 108 is inserted into the opened portion of the braid 22 as shown in FIG. 7. At this time, the braid 22 is sandwiched between the outer periphery of the punch 108 and the inner periphery of the die 7 and sheared or cut instantaneously. This is performed to exclude the redundant segment at the tip of the braid 22 and define the protruding length of the braid 22 of the outer sheath 20.

The main part of the cutting device inclusive of the punch 108 and die 107 moves backward along a guide rail 119 by the function of the servo motor and ball screw shaft (not shown) so that the shielded wire 105 is extracted from the die 107. In this state, when the braid opening pallets 110 are operated several times in its empty state, owing to its vibration, the refuse of the braid is thrown into a waste box.

By moving forward or backward the main part of the cutting device using the servo motor and ball screw shaft, the cutting length of the braid 22 can be adjusted freely so as to correspond to the shielded wires 15 of the several product numbers. In this case, the braid 22 is turned over so that the inner sheath 24 is located on the inner wall of the punch 108. In this state, the braid 22 is cut by the outside of the punch 108 so that only the braid 22 can be surely cut without injuring the inner sheath 24 and the core 25.

The shielded wire 15 with the braid 22 thus partially cut is sent to the adjacent braid fold-back device 8 by the conveying device 14 (FIG. 1).

What is claimed is:

1. A braid cutting apparatus for a shielded wire comprising:

a cutting die located outside an exposed braid of the shielded wire;

means for opening said braid;

a cutting punch which is to advance inside said braid; and a guide member for guiding the braid in a direction to open further an inner sheath of said shielded wire inside said braid to an inside of said cutting punch.

2. A braid cutting apparatus according to claim 1, wherein said opening means comprises:

a pair of opening pallets which are freely reclosable, a pair of sliding members with the pair of opening pallets fixed;

a link for moving said pair of sliding members in opposite directions; and driving means for swinging said link.

3. A braid cutting apparatus according to claim 1 or 2, wherein said guide member is made dividable, and when said punch advances, said guide member is opened outwardly by said driving means and a moving means to retreat.

4. A method of cutting a braid of a shielded wire comprising the steps of:

opening an exposed braid of the shielded wire, further opening said braid along an outer slope of a guide member while guiding an inner sheath of said shielded wire inside said braid to an inside of a circular punch, and shearing said braid into a required length between said punch and a die located outside said braid while advancing said punch inside said braid.

5. A method of cutting a braid of a shielded wire according to claim 4, wherein after said braid is opened along an outer slope of said guide member, said guide member is opened outwardly.

* * * * *